United States Patent [19]

Parks et al.

[11] Patent Number: 4,457,060

[45] Date of Patent: Jul. 3, 1984

[54] RAIL ANCHOR REMOVER

[75] Inventors: Jack E. Parks; John H. Blanchfield, both of Charlotte, N.C.

[73] Assignee: Southern Railway Company, Washington, D.C.

[21] Appl. No.: 396,700

[22] Filed: Jul. 9, 1982

[51] Int. Cl.[3] ..... B23P 19/04

[52] U.S. Cl. ..... 29/239; 29/253; 254/104

[58] Field of Search ..... 29/253, 239; 254/104, 254/18; 144/193 R, 114 R, 121; 83/870; 156/584

[56] References Cited

U.S. PATENT DOCUMENTS

| | | | |
|---|---|---|---|
| 1,209,262 | 12/1916 | Church | 254/104 |
| 1,451,855 | 4/1923 | Wright | 254/104 |
| 1,880,338 | 10/1932 | Benson | 254/18 |
| 2,271,311 | 1/1942 | Shambaugh . | |
| 2,553,112 | 5/1951 | Read | 254/104 |
| 2,901,217 | 8/1959 | Boyle . | |
| 3,139,267 | 6/1964 | Athey . | |
| 4,210,281 | 7/1980 | Fee . | |
| 4,324,029 | 4/1982 | Geisser | 29/253 |
| 4,387,753 | 6/1983 | Reynolds | 254/104 |

*Primary Examiner*—Robert C. Watson

*Attorney, Agent, or Firm*—Watson, Cole, Grindle & Watson

[57] ABSTRACT

A rail anchor remover includes a wedge member affixed to a rail lifter for progressively moving an end of each rail anchor away from the rail web until it no longer grips the rail base and falls to the ground. The wedge is provided with a tailpiece having a bearing surface engaging an outer edge of the rail flange for stabilization of the wedge, and are undercut surface which slopes downwardly and inwardly from an outer side wall of the wedge and slopes at a progressively steeper angle toward the tailpiece.

7 Claims, 8 Drawing Figures

RAIL ANCHOR REMOVER

BACKGROUND OF THE INVENTION

This invention relates generally to a rail anchor remover movable along the rail of a railroad track for removing rail anchors gripped to the base of the rail.

Rail anchors of various types have been developed for preventing longitudinal creep of a rail as a train moves therealong. Rail anchors, especially the spring-type, are typically gripped to the base of the rail adjacent a cross-tie, and lie in abutting engagement with the tie. Since the tie is securely embedded in the railroad ballast, the rail anchors effect a force-coupling between the rail and its supports so that any tendency for the rail to move or creep longitudinally when loaded during passage of the train is transferred to the cross-tie itself to thereby stabilize the rail.

When replacing worn track, the rails are lifted by some suitable means for dismantling the spiked connection of the rail with the cross-ties, whereupon the anchor plates fall away from the lifted rail, while the rail anchors remain gripped to the rail base. The rail anchors are normally removed manually using a suitable implement before the rail is carted away. However, this rail anchor removing process is tedious, time-consuming and presents a safety hazard to the workmen as the spring anchors are snapped off the rail.

SUMMARY OF THE INVENTION

It is therefore an object of the present invention to provide a rail anchor remover which quickly and effectively removes the rail anchors without danger to the work crew, while in the process of lifting the rail to dismantle it from its spiked connection with a cross-ties.

Another object of this invention is to provide such a rail anchor remover which includes a wedge fixedly attached to the rail lifter which moves along the lifted rail and engages an outer end of each anchor for gradually moving it away from the rail web until it clears the edge of the rail flange whereupon it simply drops to the ground.

A further object of the present invention is to provide such a rail anchor remover wherein the wedge includes a tailpiece for stabilizing it during the anchor removing operation, and an undercut surface which slopes from a leading end of the wedge downwardly and inwardly from the wedge outer side surface and at a progressively steeper angle relative to such side surface toward the tailpiece.

A still further object of the invention is to provide such a rail anchor remover wherein the leading end of the wedge is defined by a surface which likewise slopes downwardly and inwardly from the side surface from the wedge toward the undercut surface and forms an obtuse outer angle therewith;

A still further object is to provide such a remover wherein the tailpiece presents a bearing surface in engagement with the edge of the rail flange and in longitudinal alignment with the leading end surface and a portion of the undercut surface.

Other objects, advantages and novel features of the invention will become more apparent from the following detailed description of the invention when taken in conjunction with the accompanying drawings.

DETAILED DESCRIPTION OF THE INVENTION

Figure 1:
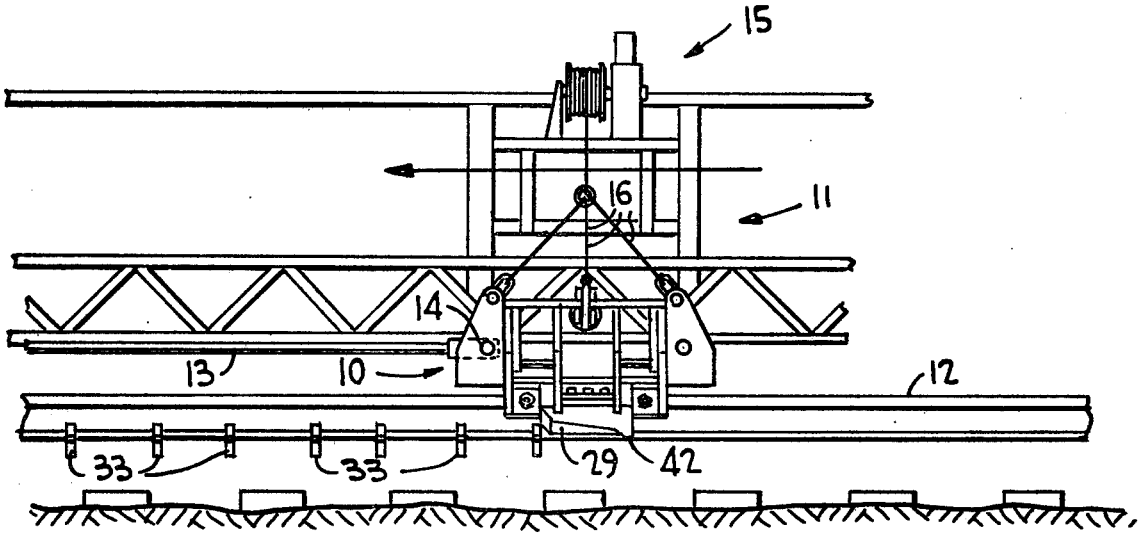
FIG. 1 is a side elevational view of the rail anchor remover according to the invention as supported on a piece of rail equipment used in the process of anchor removal.
Figure 2:
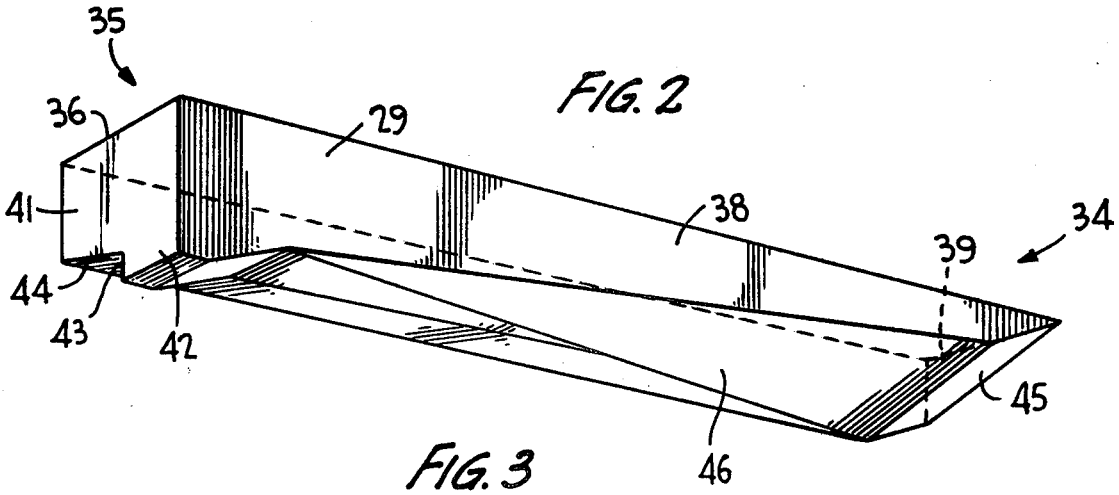
FIG. 2 is an enlarged perspective view of the wedge shown in FIG. 1, but of opposite hand.

Turning now to the drawings wherein like reference characters refer to like and corresponding parts throughout the several views, a rail lifter and rail anchor remover assembly is generally designated 10 in FIG. 1 and is mounted on a piece of railroad equipment 11 used in carrying out the anchor removing operation. This piece of railroad equipment comprises a standard machine, not otherwise shown, having rail wheels which engage a pair of temporarily anchored rails (not shown) spaced at a narrower gauge distance apart and lying between rails 12 (only one of which is shown) to be pulled. The rail equipment moves along its rails in the direction of the arrow in FIG. 1, and assembly 10 is thereby pulled by means of a rod 13 pivotally connected as at 14. The rail equipment includes a hoisting assembly 15 having hoist lines 16 for lifting and lowering assembly 10.

Figure 6:
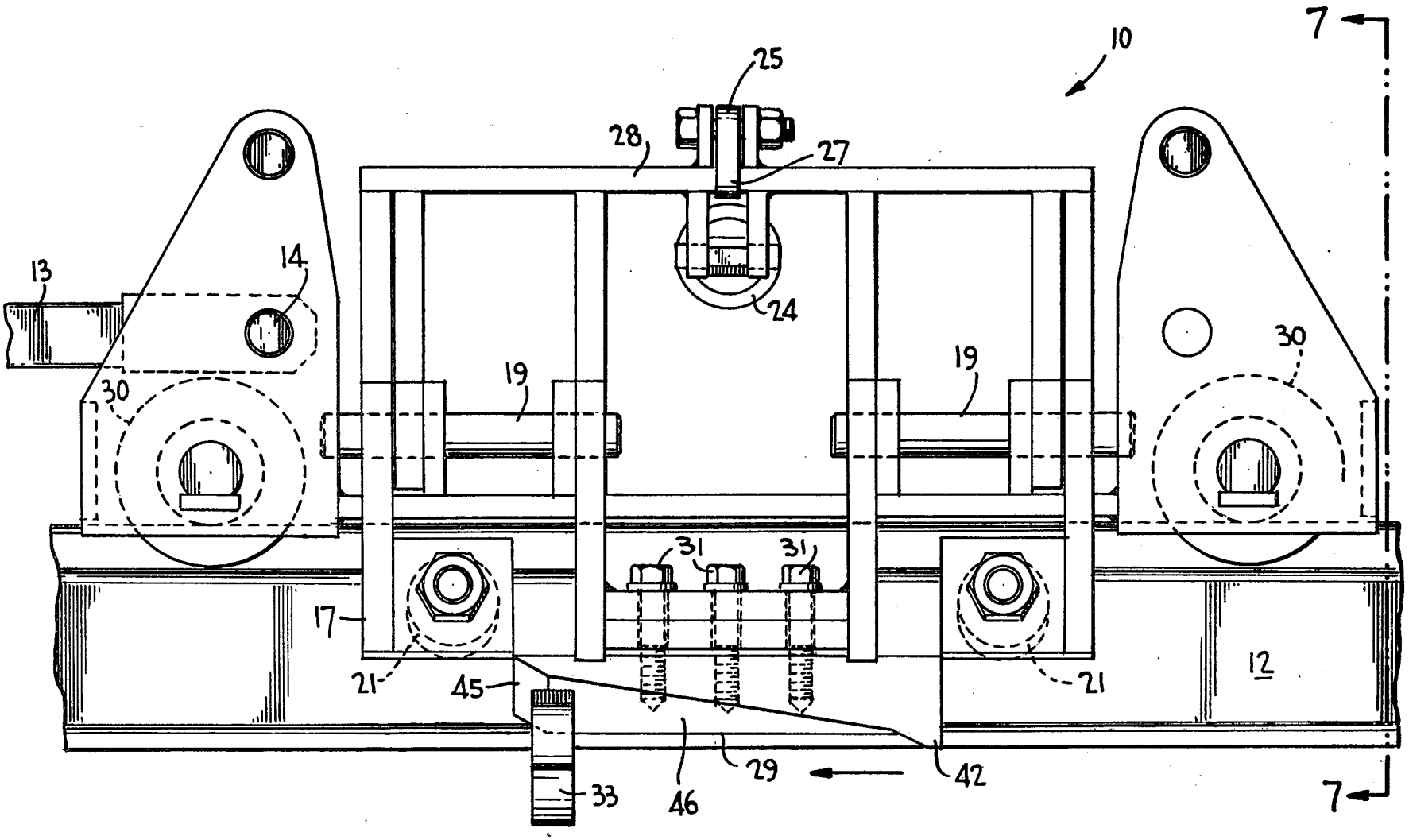
FIG. 6 is an enlarged side elevational view of the rail lifter and anchor remover assembly of FIG. 1.
Figure 7:
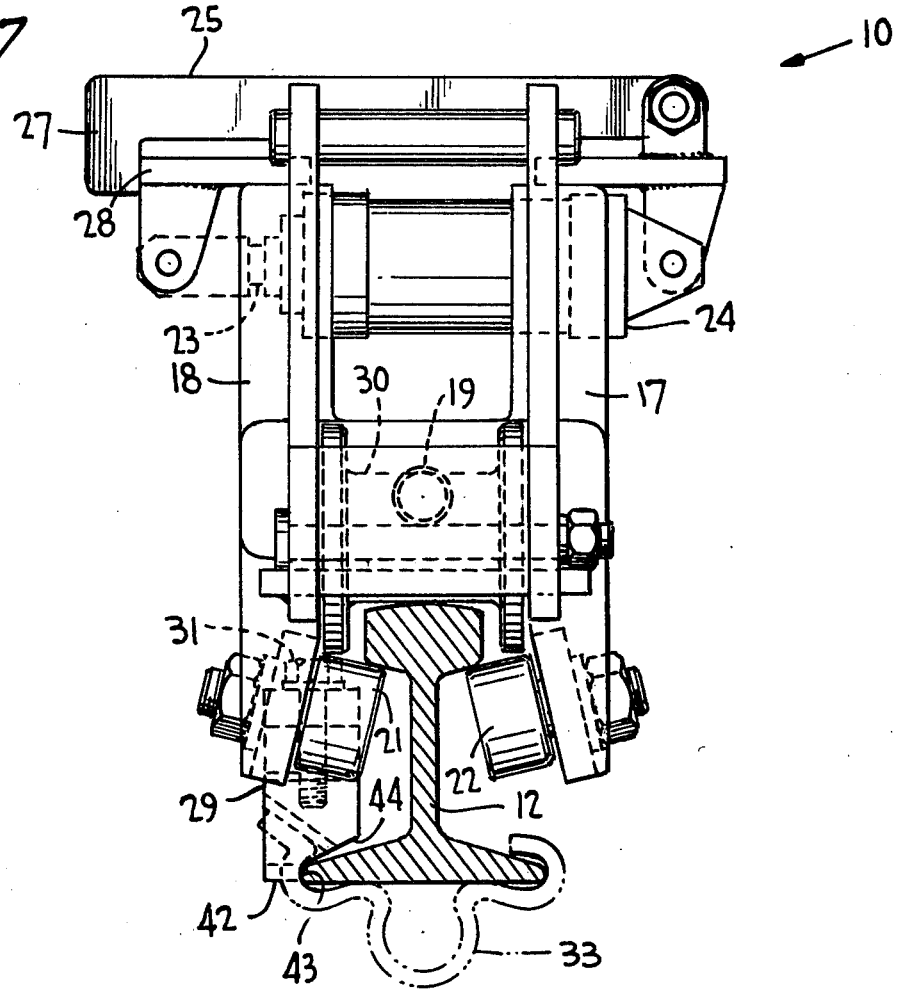
FIG. 7 is a sectional view of the assembly taken substantially along the line 707 of FIG. 6.
Figure 8:
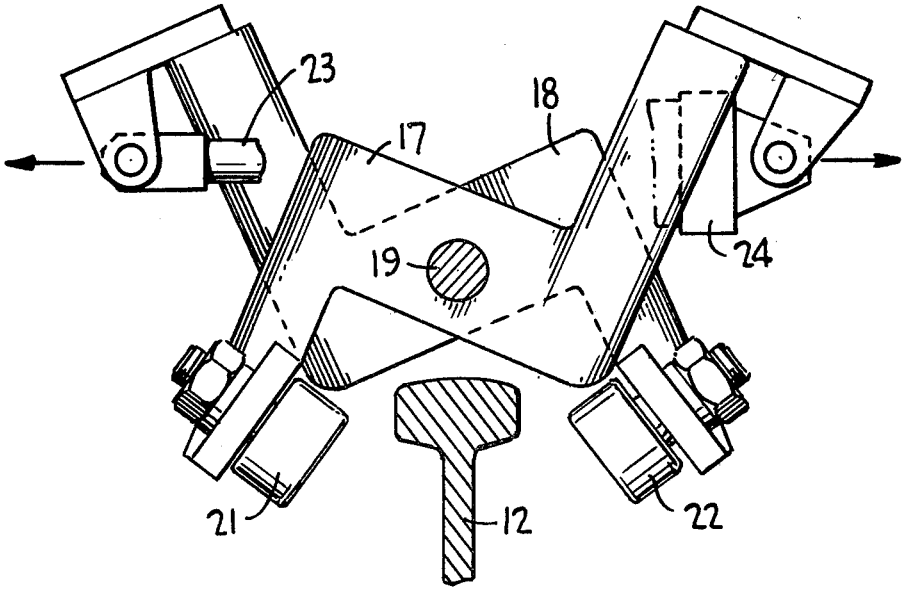
FIG. 8 is a view similar to FIG. 7 showing the rail lifter out of engagement with the rail.

This assembly is shown more clearly in FIGS. 6 to 8 as comprising a pair of substantially Z-shaped support arms 17, 18 pivotally interconnected centrally by pins 19. Arm 17 has a pair of freely rotatable rollers 21 mounted on its lower end for rotation about axes lying at an angle to the web of rail 12(FIG. 7). Rollers 21 are spaced apart (FIG. 6) in a fore-and-aft direction, and a similar pair of spaced and angularly related rollers 22 are mounted for free rotation at the lower end of arm 18. The rotational axes of rollers 21 and 22 respectively lie parallel to the undersurfaces of the rail head.

The piston 23 of a piston and cylinder unit is pivotally connected to an upper end of arm 18, and a cylinder 24 of such unit is pivotally connected at the upper end of arm 17. Thus, the upper ends of support arms 17 and 18 are moved apart into the release position of FIG. 7 upon an extension of the piston from its cylinder, and rollers 21, 22 are moved into the rail engaging position of FIG. 7 upon retraction of the piston. In the closed position of FIG. 7, the support arms may be locked together by means of a clamping arm 25 pivotally connected as at 26 to one end to assembly 10, and having a jaw 27 at its opposite end. The clamping arm is manually moved into the FIG. 7 position until its jaw 27 engages the end of a support plate 28. For disengaging rollers 21 and 22 from rail 12, arm 25 is released and piston 23 is extended from its cylinder for movement of the upper ends of support arms 17 and 18 away from one another in the direction of the arrows of FIG. 8.

Assembly 10 further includes a pair of double flanged idler rollers 30 spaced apart in a fore-and-aft direction (FIG. 6) for engaging the top of the rail head as shown in FIGS. 6 and 7.

Figure 3:
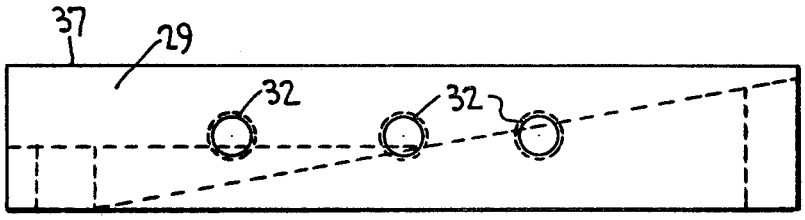
FIGS. 3, 4 and 5 are respectively top plan, side elevational and right end elevational views of the wedge of FIG. 2.
Figure 4:
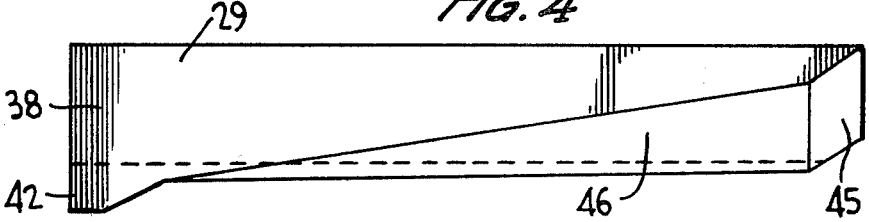

Assembly 10 includes a wedge member 29 fixedly mounted thereon as by bolts 31 (FIG. 6) and extending therebelow to an outer side of rail 12 (FIG. 7) in engagement with internally threaded holes 32 (FIG. 3). Wedge 29 is shown in FIGS. 1 and 6 for the removal of spring-type rail anchors 33 from one of the rails 12 as assembly 10 is moved in the direction of the arrows shown therein, and wedge 29 of FIGS. 2 to 5 is identical except that it is of opposite hand mounted on assembly 10 at the opposite side of the track shown in FIG. 1.

With specific reference to FIGS. 2 to 5, wedge 29 comprises an elongated, polyhedral member which may be of hardened by heat treatment to 53–55 Rockwell C, and having leading and trailing ends 34 and 35. Upper surface 36 of the wedge lies in an essentially horizontal plane when fixed in place, and is of rectangular configuration. Inner and outer side surfaces 37 and 38, and front and rear surfaces 39 and 41 of the wedge are respectively parallel and extend perpendicularly from the upper surface. The undersurface of the wedge is comprised of surface sections of different shapes lying in different planes. At trailing end 35, surfaces 38 and 41 are extended to define the outer perimeter of a downwardly directed tailpiece 42. The tailpiece extends only partially in a transverse direction and presents an inner surface 43 lying parallel to the longitudinal axis of the wedge for stabilizing the wedge relative to the rail as this surface engages an outer edge of the rail flange, as shown in FIG. 7. Inwardly of the tailpiece the undersurface of the wedge slopes outwardly and upwardly to the horizontal as at 44, throughout about 15° along the full length of the wedge. With such design, the wedge is in contact with the rail only at surface 43 to thereby minimize frictional drag between the moving wedge and the rail.

Figure 5:
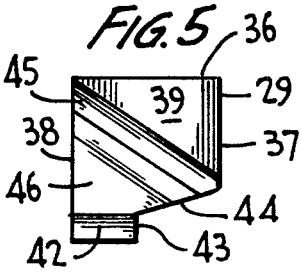

At the leading end, undersurface section 45 extends downwardly and inwardly from surfaces 38 and 39 toward another undersurface section 46 with which it intersects at an outer obtuse angle. This surface 46 slopes downwardly and inwardly from side surface 38 at a progressively steeper angle relative to the side surface toward tailpiece 42 and is slidably engagable with an end of the rail anchor for progressively removing it from the rail upon travel of assembly 10 in a forward direction. And, as seen in FIG. 5, inner surface 43 of the tailpiece is aligned with a portion of surface 46 so that the wedge slides along the outer edge of the rail flange when surface 46 engages the outer end of the rail anchor. And, FIG. 2 clearly shows that surface 46 intersects side surface 38 of the wedge along a downwardly and a rearwardly sloping line.

In operation, railroad equipment 11 is disposed for movement along the inner, narrower gauge rails for pulling assembly 10 along rail 12 by rod 13. Assembly 10 is lowered by hoisting assembly 15 onto the rail upstream of the position shown in FIG. 1 at which it is spike connected to the cross-ties. When lowering assembly 10, support arms 17 and 18 are in the released position of FIG. 8 with their rollers 21 and 22 spread apart relative to the rail, so that rollers 30 may bear against the upper surface of the rail head. The piston and the cylinder unit is then actuated so as to retract piston 23 to thereby move rollers 21 and 22 toward the rail into engagement with the undersides of the rail head, as shown in FIG. 7. Clamping bar 25 is then manually moved into its clamping engagement with plate 28. Assembly 10 is then lifted upon operation of hoisting assembly 15 whereupon the spiked connections of the rail are dismantled from their support ties, the spikes and the rail seats (not shown) being allowed to simply fall away from the rail. Rail anchors 33 remain gripped to the base of the rail and are removed as railroad equipment 11 is moved in the direction of the arrow of FIG. 1. Several of these rail anchors are shown already removed to the right of the centerline in FIG. 1, and FIGS. 6 and 7 show a typical rail anchor in the process of being removed. Surface 45 of the wedge at the leading end slopes away from the confronting surface of the rail anchor as shown in FIG. 6, so as to ensure engagement between this rail anchor surface and surface 46 of the wedge. As assembly 10 continues to travel in the direction of the arrows in FIGS. 1 and 6, the end of the anchor which overlaps the outer edge of the rail flange is progressively moved away from the rail web upon relative sliding movement between the anchor and surface 46 which slopes at a progressively steeper angle outwardly of the wedge. Before contacting the tailpiece, which counters any tendency of the wedge to move inwardly of the rail during the removal process, the rail anchor is completely freed of the rail base and falls to the ground. During its continued forward movement, the rail remains elevated above the ground as rollers 21 and 22 of assembly 10 engage the undersurfaces of the rail head. During such rolling movement, rollers 30 are in light contact with the top of the rail head, or may be spaced slightly therefrom. Upon encountering the next rail anchor, it is engaged by the wedge and is removed from the rail base as aforedescribed.

It should be pointed out that the machine used in carrying out the rail anchor removal process may be equipped with another assembly 10 at the opposite side of the track from that shown in FIG. 1 for simultaneously lifting the other rail of the track and removing the rail anchors in the manner described above. Left hand and right hand wedges are simply affixed to the opposed assemblies 10 for carrying out this simultaneous anchor removal operation.

Obviously, many modifications and variations of the present invention are made possible in the light of the above teachings. It is therefore to be understood that within the scope of the appended claims the invention may be practiced otherwise than as specifically described.

What is claimed is:

1. An assembly for removing rail anchors gripped to the base of a rail, comprising means for lifting the rail away from attached railroad ties, means for moving said lifting means in a forward direction along the rail while lifted from the ties, a polyhedral wedge member fixedly secured to said lifting means for engaging an outer free end of a rail anchor to effect removal by movement of said free end outwardly away from the rail web during movement along said direction, said wedge member having an undersurface section extending in a rearward direction from a leading end of said wedge member for engaging the outer free end of the rail anchor, a tailpiece at the trailing end of said wedge member adjacent said undersurface section for engaging an outer edge of the rail base, said undersurface section sloping downwardly and inwardly from an outer side surface of said wedge member at a progressively steeper angle relative to said side surface toward said tailpiece.

2. The assembly according to claim 1, wherein said wedge member has a further undersurface section at said leading end which slopes downwardly and inwardly toward said first-mentioned undersurface section and intersects therewith forming an outwardly obtuse angle.

3. The assembly according to claim 1, wherein said lifting means includes rail engaging means comprising a pair of pivotally interconnected support arms having opposing ends respectively movable toward and away from one another in scissors-like fashion, freely rotatable rollers on lower ends of said arms for engaging the underside of the rail head, and means interconnecting upper ends of said arms for moving said upper ends toward and away from one another respectively into rail head engaging said disengaging positions.

4. A wedge for use in removing rail anchors gripped to the base of a rail, comprising an elongated, polyhedral member having leading and trailing ends, a downwardly extending tailpiece at said trailing end having an inner bearing surface for engagement with an edge of the rail flange, said member having an undersurface section which slopes downwardly and inwardly from a side surface of said member from said leading end at a progressively steeper angle relative to said side surface toward said tailpiece, said undersurface section being slidably engagable with an end of a rail anchor for progressively removing same from the rail upon travel of said member in a forward direction.

5. The wedge according to claim 4, wherein said undersurface section intersects said side surface along a line which slopes downwardly toward said tailpiece, said side surface forming a surface of said tailpiece.

6. The wedge according to claim 4, wherein said leading end is defined by a surface which slopes downwardly and inwardly from said side surface toward said undersurface section and forms an obtuse outer angle therewith.

7. The wedge according to claim 6, wherein said member is of a constant width between said ends, and said inner bearing surface lying in a longitudinal plane intersecting a portion of said undersurface section.

* * * * *